US006372273B1

(12) United States Patent
Mabry et al.

(10) Patent No.: US 6,372,273 B1
(45) **Date of Patent: *Apr. 16, 2002**

(54) DUAL WEB PACKAGE HAVING IMPROVED GASEOUS EXCHANGE

(75) Inventors: James R. Mabry; Henry Walker Stockley, III, both of Sparatanburg; E. Susanne Troutt, Moore, all of SC (US)

(73) Assignee: Cryovac, Inc., Duncan, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/884,759

(22) Filed: Jun. 30, 1997

Related U.S. Application Data

(63) Continuation of application No. 08/470,283, filed on Jun. 6, 1995, now Pat. No. 5,686,127.

(51) Int. Cl.[7] ..... B65D 85/00

(52) U.S. Cl. ..... 426/129; 426/106; 426/396; 426/410; 220/359; 220/336.1; 220/378

(58) Field of Search ..... 426/115, 118, 426/119, 106, 127, 129, 396, 410, 415; 206/484.1; 220/359, 366.1, 378, 806

(56) References Cited

U.S. PATENT DOCUMENTS

| | | | | |
|---|---|---|---|---|
| 2,260,064 | A | 10/1941 | Stokes | 93/3 |
| 2,595,708 | A | 5/1952 | Salfisberg | 206/46 |
| 2,623,826 | A | 12/1952 | Grinstead | 99/174 |
| 2,925,346 | A | 2/1960 | Harper | 99/174 |
| 3,360,382 | A | 12/1967 | Miller | 99/174 |
| 3,561,668 | A | 2/1971 | Bergstrom | 229/43 |
| 3,574,642 | A | 4/1971 | Weinke | 99/174 |
| 3,681,092 | A | 8/1972 | Titchenal et al. | 99/174 |
| 3,713,849 | A | 1/1973 | Grindrod et al. | 99/174 |
| 3,783,089 | A | 1/1974 | Hurst et al. | 161/166 |
| 3,891,775 | A | 6/1975 | Murray et al. | 426/107 |
| 4,055,672 | A | 10/1977 | Hirsch et al. | 426/127 |
| 4,136,203 | A | 1/1979 | Murphy et al. | 426/124 |
| 4,438,850 | A | 3/1984 | Kahn | 206/634 |
| 4,522,835 | A | 6/1985 | Woodruff et al. | 426/264 |
| 4,840,271 | A | 6/1989 | Garwood | 206/213 |
| 4,847,148 | A | 7/1989 | Schirmer | 428/332 |
| 4,886,690 | A | 12/1989 | Davis et al. | 428/36.6 |
| 4,889,731 | A | 12/1989 | Williams, Jr. | 426/106 |
| 4,901,505 | A | 2/1990 | Williams, Jr. | 53/412 |
| 4,910,033 | A | 3/1990 | Bekele t al. | 426/129 |
| 5,132,151 | A | 7/1992 | Graney et al. | 428/40 |
| 5,226,531 | A | 7/1993 | Garwood | 206/213.1 |
| 5,348,752 | A | 9/1994 | Gorlich | 426/129 |
| 5,419,096 | A | 5/1995 | Gorlich | 53/432 |
| 5,419,097 | A | 5/1995 | Gorlich et al. | 53/432 |
| 5,439,132 | A | 8/1995 | Gorlich | 220/359 |
| 5,686,127 | A | * 11/1997 | Stockley, III et al. | 426/129 |

FOREIGN PATENT DOCUMENTS

| | | |
|---|---|---|
| DE | 2 240 234 | 8/1971 |
| GB | 2 251 540 A | 7/1992 |

* cited by examiner

*Primary Examiner*—Curtis E. Sherrer
(74) *Attorney, Agent, or Firm*—Thomas C. Lagaly

(57) ABSTRACT

A package for a product, including:

a support member having a peripheral flange and a cavity for receiving a product;

a permeable film partially sealed to said flange to enclose the product;

at least one channel between the permeable film and and flange; and an impermeable film enclosing the permeable film and at least one channel, the impermeable film being removable from the package such that removal thereof allows gas to flow into and out of the cavity through the at least one channel. The channel may comprise one or more grooves in the flange; a nonsealable substance present between the permeable film and the flange; or at least one corona-treated area of the flange, the permeable film, or both.

2 Claims, 4 Drawing Sheets

FIG. 8
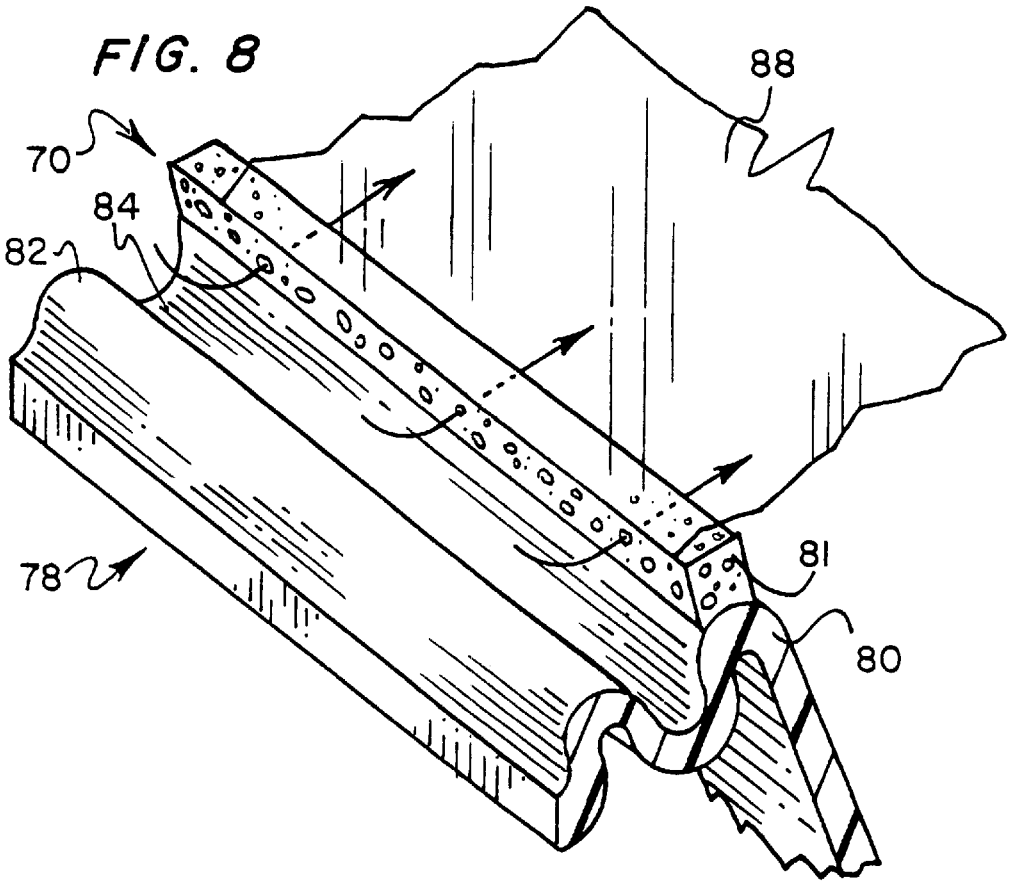
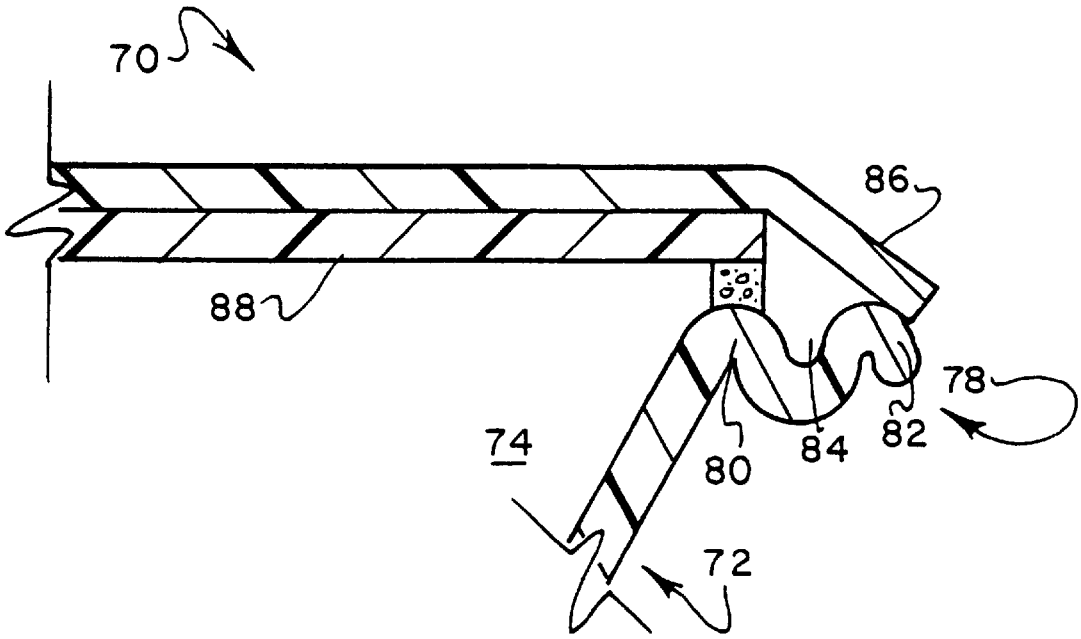
FIG. 9

DUAL WEB PACKAGE HAVING IMPROVED GASEOUS EXCHANGE

This application is a continuation of Ser. No. 08/470,283 filed Jun. 6, 1995 U.S. Pat. No. 5,686,127.

BACKGROUND OF THE INVENTION

The present invention relates generally to packages for fresh red meat. Particularly, this invention is directed to the packaging of food products such that the packaged product may be maintained in one condition under certain circumstances and then converted to another condition. Specifically, packages in accordance with the present invention provide for distribution of a packaged product in a low oxygen environment and for introduction of oxygen to the product surface at a supermarket or other retail outlet. Such introduction of oxygen is achieved either by permeation of oxygen through a film in contact with the product surface or through an exchange of atmospheric oxygen with a low oxygen gaseous atmosphere contained around the product.

While a wide variety of food products can be packaged in accordance with the teachings of this invention, it is particularly advantageous in connection with the packaging of fresh red meat such that the meat may be transported in a low oxygen atmosphere, that is, preferably 0.5% $O_2$ or less, most preferably 0.05% $O_2$ or less, and then caused to bloom when it reaches a supermarket by exposure to oxygen.

Historically, large sub-primal cuts of meat have been butchered and packaged in each supermarket. This, however, can be inefficient and result in certain undesirable additional costs. For example, all cuts from a large sub-primal must be sold at once. Instead it would be preferable to permit the meat to be butchered and packaged at a central facility which benefits from economies of scale and thereafter shipped to individual supermarkets such as is done, for example, with many poultry products.

In the past, the goal of central fresh red meat processing has not been achievable because most consumers prefer to buy meat which is reddened in color as a result of exposure to oxygen. However, the meat maintains its reddened color for approximately one to three days and, thereafter, turns a brown color which is undesirable to most consumers.

Therefore, if the meat was butchered and packaged in a gas permeable (hereinafter "permeable") film, as is typical at retail, at a central location and then shipped to another location for eventual sale, in all likelihood, by the time the package reached the retail outlet the meat would have undergone the transformation to the brown color and would be effectively unsalable. Conversely, if the meat was butchered and packaged at a central location in a gas-impermeable (hereinafter "impermeable") film, either under vacuum or with vacuum and a low oxygen gas flush, and then shipped to another location for eventual sale, the meat would reach the retail outlet having a purple color which is typical of meat prior to exposure to oxygen. Heretofore, marketing efforts to teach the consumer about the harmlessness of the purple color have proved to be difficult. And, if the gas impermeable film was a component of a conventional package having a tray which is overwrapped or lidded with a film and which contains a low oxygen atmosphere, the impermeable film would have to be removed and replaced with a permeable film in order to allow for bloom of the meat to a bright red color prior to display for the consumer, negating to a large extent the benefits of a central processing facility.

A variety of packages have been developed in an effort to provide a means for transporting meat in a low oxygen environment and for quickly and easily introducing oxygen to the meat at the retail outlet immediately prior to display to the consumer.

One approach to solving this problem has involved the development of peelable films. That is, films have been developed which readily delaminate into permeable and impermeable portions. Such a film is sealed to a support member, such as a tray, which contains the meat product, thereby forming a gas impermeable package for distribution. At the retail outlet, the gas impermeable portions are peeled from the film leaving a permeable film sealed to the tray and, therefore, a gas permeable package which allows the meat to bloom to bright red because of the exchange with atmospheric oxygen.

The peelable film may extend over the contained product and be sealed to the periphery of the tray as a lid or it may be heated and draped over the product under vacuum to form to a vacuum skin package. However, for both types of packages the principal drawback is the relatively low gas transmission rate of the permeable film portion after removal of the impermeable portion. That is, although the permeable portion of the peelable film has a much higher gas transmission rate than that of the entire film prior to delamination, 5,000 to 25,000 cc/$m^2$/24 hrs./atm. at 73° F. as compared to 0 to 50 cc/$m^2$/24 hrs./atm. at 73° F. prior to delamination, it is still too low to effect bloom of the packaged meat in a low oxygen gaseous atmosphere in a short period of time, except in areas of intimate permeable film to meat contact.

Most of the other approaches to achieving the goal of central fresh red meat processing have involved the development of a variety of dual web packages of the type having a permeable film covering the meat product and an impermeable film, which is removed at the retail outlet, covering the permeable film wherein the permeable film and the impermeable film are separate, discreet films.

Examples of these types of packages include dual overwrap packages wherein a permeable film is wrapped around the meat and its support member and an impermeable film is wrapped about the permeable film; dual lid packages which include a permeable lid and an impermeable lid seeled to the periphery of the support member; and packages with a head space which allows for the introduction of a treating gas, typically nitrogen, carbon dioxide or some mixture of the two, between a permeable film adjacent to the meat product and an impermeable upper web. But, as is the case with the peelable films discussed above, each of these dual web packages are limited in their effectiveness by the permeability of the permeable film. Typical gas transmission rates for commercially viable gas permeable films are 5,000 to 25,000 cc/$m^2$/24 hrs./atm. at 73° F. which is too low to effect rapid red meat bloom by exchange of the low oxygen gases out and the atmospheric oxygen in.

A further package developed to allow for central fresh red meat processing includes a gas impermeable upper lid with a valve defined in the lid. The package may include a treating gas between the packaged meat and the upper lid during distribution which is withdrawn through the valve and replaced with an oxygen-rich gas. Although a rapid bloom is possible with this system, it has the disadvantages of requiring trained operators at the retail outlet and relatively expensive equipment to exchange each package thus negating the cost savings of a central processing facility. The presence of the valve has the further disadvantage of creating a package appearance which is different from that which consumers are accustomed to seeing for meat packaging. Further, a gas space between the meat product and the impermeable film is required to maintain a bloomed color which yields an underfilled package appearance.

Yet another package developed to allow for central fresh red meat processing provides for an excellent exchange of gases and rapid introduction of oxygen in which an upper impermeable web covers a lower permeable web which includes unsealed areas in the seal of the permeable web to the tray. However, the intermittent sealed and nonsealed areas are formed by an altered sealing head which comprises a series of sealing "fingers" rather than a conventional, continuous sealing surface.

Thus, it is desirable to provide a package which allows for central processing of fresh red meat with minimal processing required at retail; which is similar in appearance to that which consumers are accustomed to seeing for meat packaging; which allows for rapid bloom of fresh red meat; and which can be assembled, filled and sealed at a central processing facility on conventional equipment.

SUMMARY OF THE INVENTION

The present invention provides a package for a product, comprising:

- a support member having a peripheral flange and a cavity for receiving a product;
- a permeable film partially sealed to said flange to enclose the product;
- at least one channel between the permeable film and and flange; and
- an impermeable film enclosing the permeable film and at least one channel, the impermeable film being removable from the package such that removal thereof allows gas to flow into and out of the cavity through the at least one channel.

The channel may comprise one or more of the following embodiments:

- one or more grooves in the flange;
- a nonsealable substance present between the permeable film and the flange; or
- at least one corona-treated area of the flange, the permeable film, or both.

BRIEF DESCRIPTION OF THE DRAWINGS

A detailed description of preferred embodiments of the invention follows, with reference to the accompanying drawings, wherein:

FIG. 8 is an enlarged sectional view of a flange of a package, according to the invention, showing a gasket sealed to the permeable film and to the flange after removal of the impermeable film; and FIG. 9 is a cross-section of the package of FIG. 8 with the impermeable film sealed to the flange.

DETAILED DESCRIPTION OF THE PREFERRED EMBODIMENTS

The present invention relates to a package for products, particularly fresh red meat products, having a tray, an inner non-barrier or permeable film sealed to the flange of the tray, and an outer barrier or impermeable film sealed to the flange of the tray, wherein unsealed areas between the permeable film and the tray provide for a rapid introduction of oxygen into the tray cavity upon removal of the outer impermeable film. The unsealed areas may either provide open channels into the tray cavity, or may contain foreign objects which, upon removal of the impermeable film, provide such open channels or which have an exceptionally high oxygen permeability such that an open channel is not required for rapid gas exchange.

Figure 1:
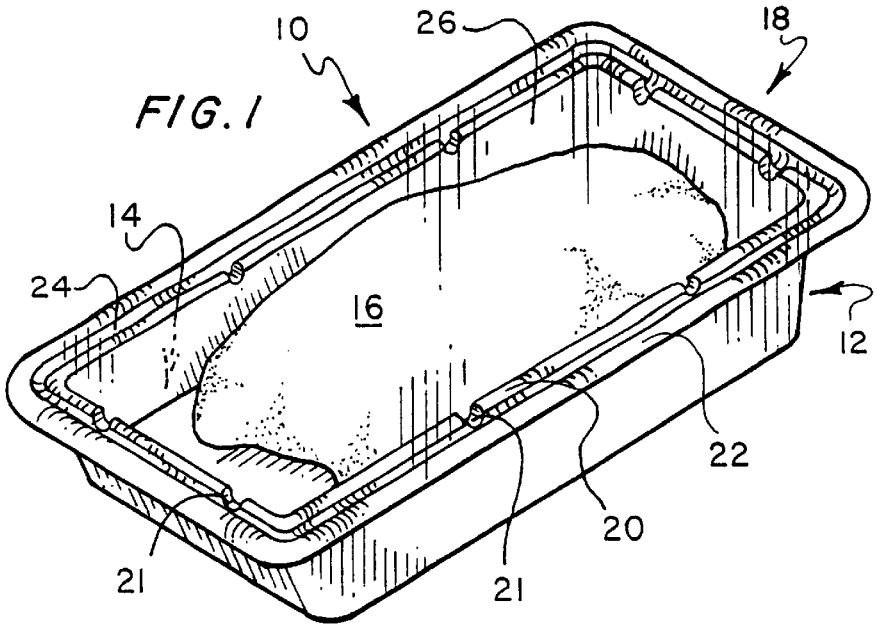
FIG. 1 is a perspective view of a package, according to the invention.

Generally, one or more open channels between the permeable film and the flange of the tray may be formed by either grooves or ridges defined within the tray flange; a nonsealable substance applied to the flange, the sealing surface of the permeable film or both; or a corona-treated area of the flange, the permeable film, or both. The former is illustrated in FIG. 1 of the drawings which shows a package 10 in accordance with the present invention having a tray or support member 12 with a cavity 14 for receiving a product 16 and a peripheral upper flange 18 which includes inner flange portion 20 and outer flange portion 22 separated by depression 24. Depression 24 allows for trimming of any film sealed to the inner flange portion 20 and provides a clear delineation between the sealing area for an inner permeable film and an outer impermeable film.

In the present embodiment, inner flange portion 20 includes one or more grooves 21 defined therein and spaced about the perimeter of the flange. A top impermeable film 26 is sealed to the support member at outer flange portion 22. Preferably, a peelable seal is formed between the impermeable film 26 and outer flange portion 22 such that the outer impermeable film may be readily removed from the package at retail.

Figure 2:
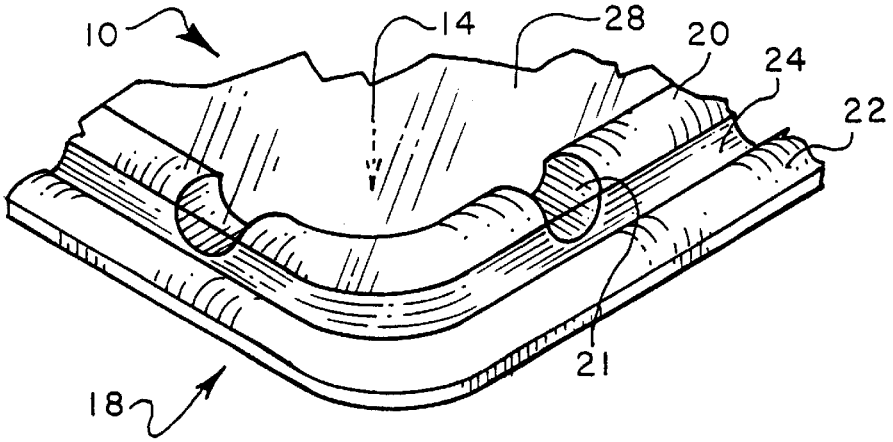
FIG. 2 is an enlarged sectional view of a flange of a package, according to the invention, showing the seals of the permeable film and channels defined within the flange.
Figure 3:
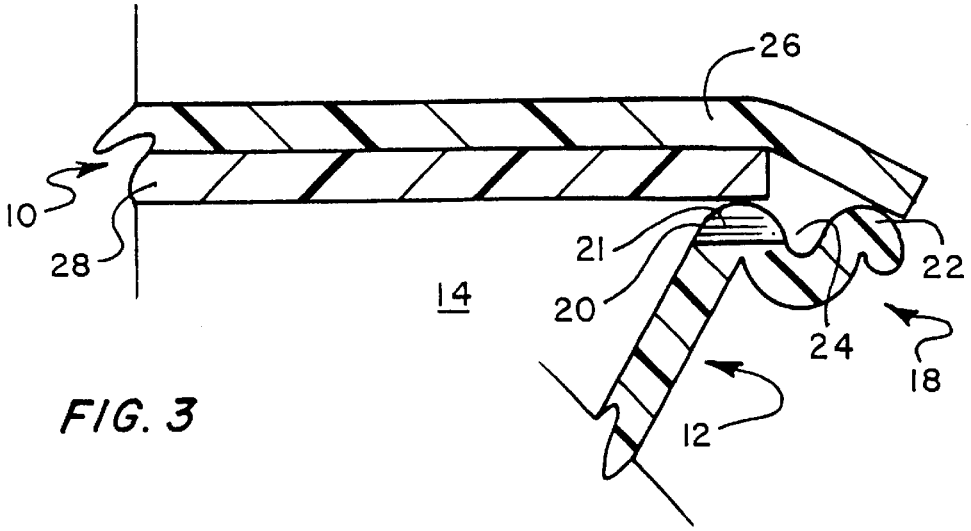
FIG. 3 is a cross-section of the package of FIG. 1, showing the seals of the permeable and impermeable films.

FIG. 2 is an enlarged sectional view of the flange 18 of package 10 after removal of impermeable film 26. Permeable film 28 is sealed to the support member at inner flange portion 20. However, grooves 21 defined in inner flange portion 20 provide for open channels between the tray cavity 14 and depression 24. When impermeable film 26 is sealed to outer flange portion 22, depression 24 is enclosed, as is shown in FIG. 3. However, upon removal of film 26, depression 24 and grooves 21 define open channels into tray cavity 14. Preferably, during packaging the tray cavity 14 is flushed with a low oxygen gas such as, for example, nitrogen, carbon dioxide, or, preferably, a mixture of the two. Removal of impermeable film 26 allows for a rapid release of the low oxygen gases contained within the package and for a rapid introduction of oxygen into the package thereby blooming the packaged fresh red meat product.

Figure 4:
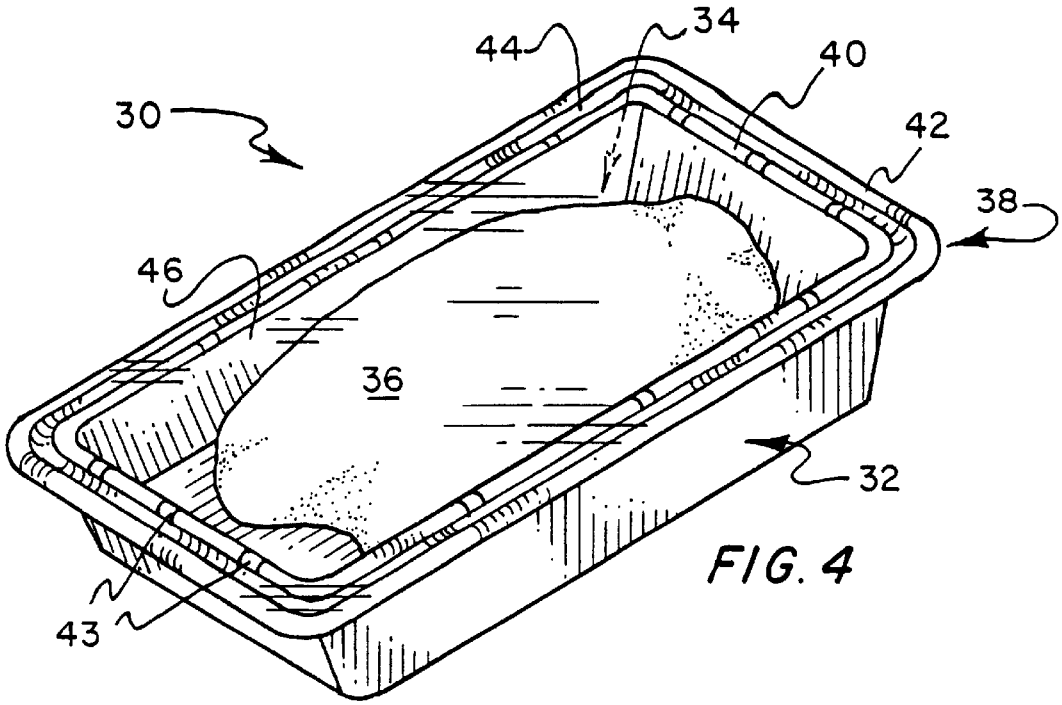
FIG. 4 is a perspective view of a package, according to the invention.
Figure 5:
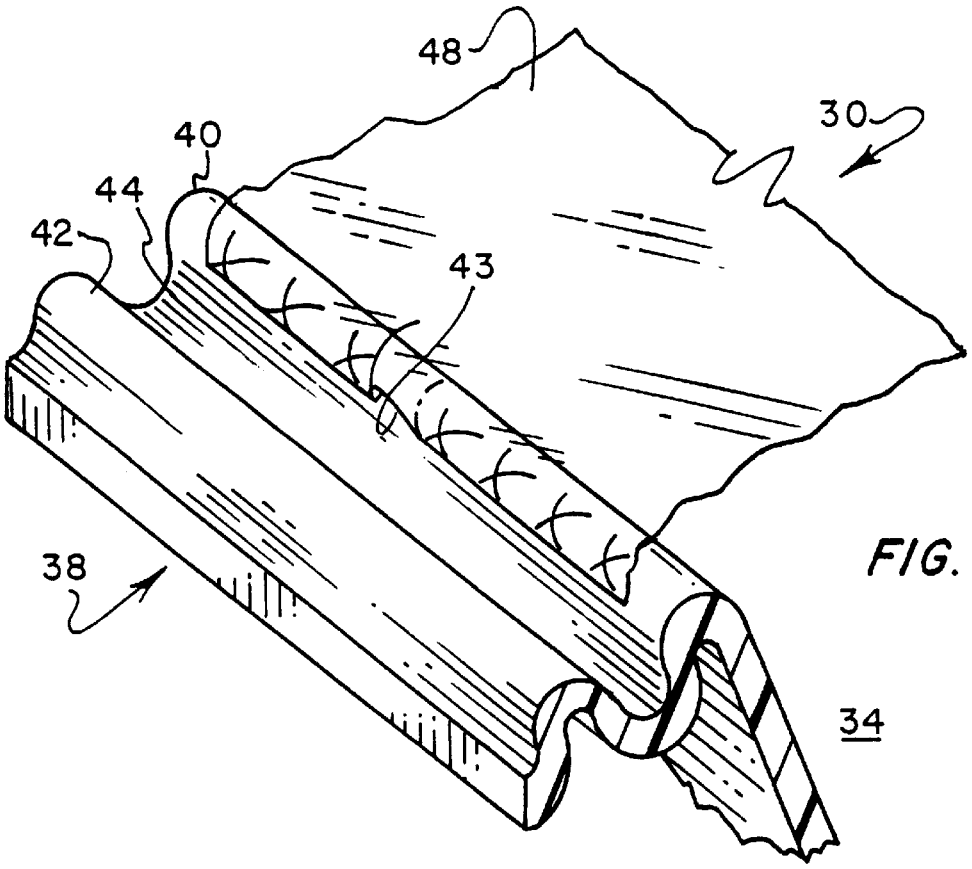
FIG. 5 is an enlarged sectional view of the flange of the package of FIG. 4 after removal of the impermeable film.

Open channels between the permeable film and the flange of the tray which may also be formed by a nonsealable substance applied to the flange, the sealing surface of the permeable film or both, as represented in FIGS. 4 and 5 of the drawings. FIG. 4 shows a package 30 in accordance with the present invention having a tray or support member 32 with a cavity 34 for receiving a product 36 and a flange 38 which includes inner flange portion 40 and outer flange portion 42 separated by depression 44.

In the present embodiment, one or more nonsealed areas 43 are defined between inner flange portion 40 and permeable film 48 and are spaced about the perimeter of the flange. As can be seen from the drawing of FIG. 4, the top impermeable film 46 is sealed to the support member at outer flange portion 42. Hereagain, it is preferred that a peelable seal is formed between the impermeable film 46 and outer flange portion 42 such that the outer impermeable film may be readily removed from the package at retail.

FIG. 5 is an enlarged sectional view of the flange 38 of package 30 after removal of impermeable film 46. Permeable film 48 is sealed to the support member at inner flange portion 40 but with the nonsealed areas 43 providing open channels between the tray cavity 34 and the external atmosphere. Upon removal of impermeable film 46, nonsealed areas 43 define open channels into tray cavity 34 allowing for a release of any contained low oxygen gases and a rapid introduction of oxygen and, therefore, rapid blooming of any packaged fresh red meat product. Unlike the embodiment of FIGS. 1–3, the present embodiment does not require that the depression between the inner and outer flange portions is employed in forming the open channels between the tray cavity and the atmosphere. Thus, a single flange tray may be employed in the present embodiment so long as the impermeable film seal is formed external to the permeable film seal, either at the upper surface of the single flange or in an overwrap configuration. However, a dual flange tray such as is illustrated here has the advantage of facilitating the packaging process because the depression between the two flange portions allows for uniform trimming of the permeable film after sealing.

The nonsealed areas of package 30 of FIGS. 4 and 5 may be formed by the inclusion of a nonsealable material at the sealing surface of the permeable film, the inner flange or both. Examples of nonsealable materials which may be employed in accordance with the present invention include solids such as corn starch or other powders, liquids such as olefin glycols and nonsealable resins or gels.

The nonsealable material may be applied to the surface of the film, the flange or both or may optionally be incorporated into the surface of either structure during its manufacture. That is, both the film and the support member are comprised of one or more polymeric resins. The film may be either a monolayer or a multilayer structure. The layer which is sealed to the support member is comprised of a resin or a blend of resins which are capable of forming a seal, preferably a heat seal, with the flange of the support member. Similarly, the support member, which is preferably gas impermeable, is at least partially comprised of one or more polymeric resins. One preferred support member structure for use in the present invention is a barrier foamed tray comprising a foamed substrate of a resin such as polystyrene or polypropylene with a barrier sealant film laminated thereto. Non-foamed polymeric materials or pulp or paperboard may also be employed in the base tray as long as the upper surface is coated or laminated with a material which is capable of forming a seal, preferably a heat seal, with the permeable film and the impermeable film.

Sealability between the support member and the permeable and impermeable films depends on a variety of factors including melting point, softening point and crystallinity of the resins employed in the sealing layers, the type of seal to be formed and the degree of sealing desired. For example, in the seal between the support member flange and the impermeable film it is generally preferred that a peelable seal is formed in order to allow for ready removal of the impermeable film at retail. The provision of a nonsealable resin, one, for example, with a melting point and corresponding softening point too high to form heat seals at the desired sealing temperature, spaced throughout the sealing surface of one of the members to be sealed will result in nonsealed areas.

Because it is necessary to form an airtight seal between the support member outer flange portion and the impermeable film, it is generally preferred that any nonsealable resin not be included in the outer flange portion of the support member, although it would be possible to provide a resin which is not sealable to the permeable film but is sealable to the impermeable film. In general, it is preferred that any nonsealable resin be incorporated into the sealing surface of the permeable film. That is, stripes of a nonsealing resin may be incorporated into the sealing surface of the permeable film during its manufacture. During packaging, as a roll of the permeable film is employed to cover the product in the tray cavity and is sealed to the inner flange portion of the tray about the periphery thereof, the stripes of nonsealable resin form nonsealed areas such as are shown at FIG. 5. The impermeable film encloses the product but upon its removal the nonsealed areas provide open channels allowing for a rapid introduction of oxygen to the packaged product.

The nonsealed areas 43 of package 30 as shown in FIGS. 4 and 5 may also be formed by a one or more corona-treated areas of the flange, the permeable film, or both. When a sufficiently high dosage of corona treatment (as controlled by the intensity of the applied corona plasma, the duration of exposure thereto by the film or flange, or both) is applied to the permeable film and/or flange, it has been found that the permeable film will not readily seal to the upper flange of the support member under typical heat-sealing conditions.

In a preferred embodiment, only the permeable film is subjected to corona treatment. Preferably, such corona treatment of the permeable film is included as a final step in the manufacture of the film. The permeable film (and impermeable film) may be manufactured by any appropriate method. Preferably, the layer or layers of the film will be extruded or coextruded through either a slot die or an annular die forming either a sheet or a tube, respectively. While the extruded polymeric material is still in a molten state the sheet or tube may be expanded by stretching or blowing to achieve a desired dimension. The film is then cooled, slit to desired widths and taken up as a roll. Such rolls of film are employed in the packaging process as is discussed in greater detail below. Prior to the final take-up of the permeable film as a roll, it is subjected to selective corona treatment. It is preferred that narrow widths of the length of the film are subjected to corona treatment at intermittent locations across the width of the film, thereby forming corona treated "stripes" along the length of the film. Other means of forming corona treated areas which will eventually overlap with the seal of the permeable film to the tray such as, for example, small spaced areas of corona treatment across the entire surface of the film, are also within the scope of the invention. However, corona treated "stripes" are generally preferred because the location of the gaps which result from the corona treated areas can be controlled by properly indexing or registering the film during packaging.

Because corona treated "stripes" are preferred as a means for providing corona treated areas, the nonsealed areas will typically only occur on two opposing sides of the package at the permeable film seal to the tray flange. However, as other patterns of corona treatment are also within the scope of the invention, it is possible to provide nonsealed areas on three sides, or all four sides of the package at the permeable film seal to the flange. When corona treated stripes are employed, proper positioning of the film is necessary to prevent a nonsealable, corona treated stripe from precluding sealing of the permeable film to the flange along an entire side of the flange.

Figure 6:
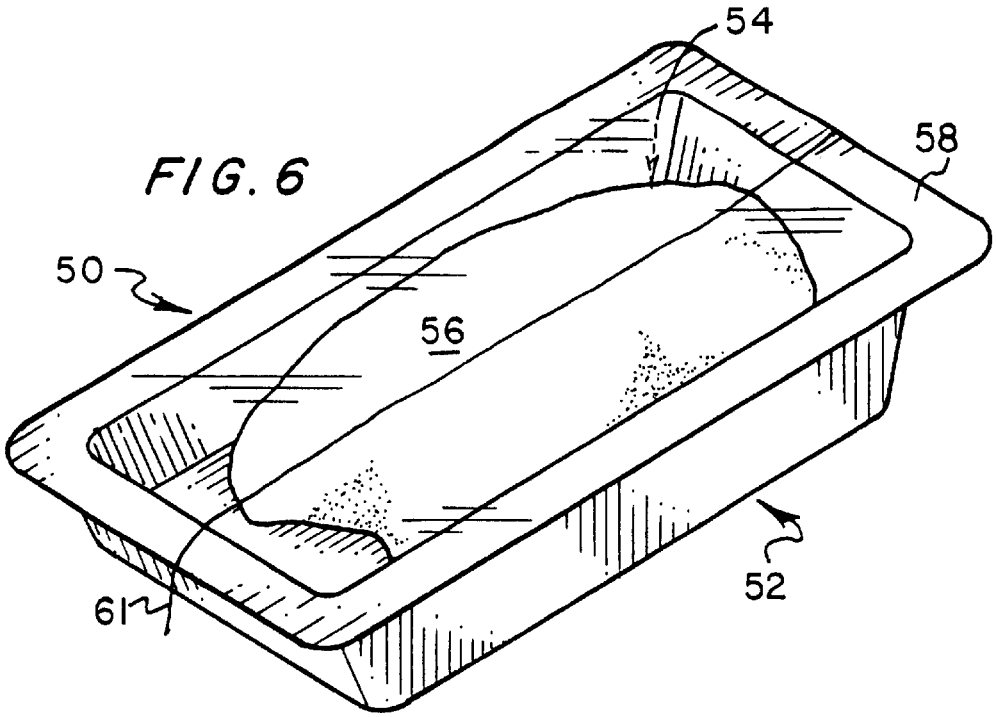
FIG. 6 is a perspective view of a package, according to the invention.
Figure 7:
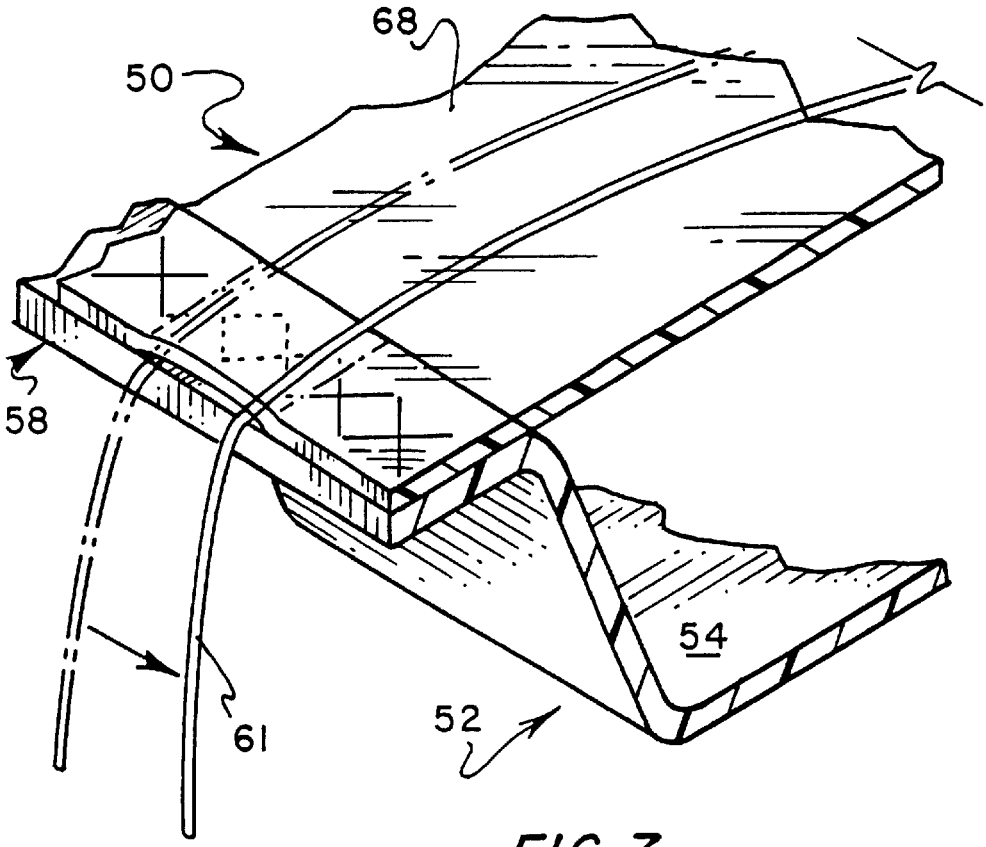
FIG. 7 is an enlarged sectional view of the flange of the package of FIG. 6 during one possible mode of operation.

FIGS. 6 and 7 illustrate an alternative embodiment of the present invention wherein the means for forming nonsealed areas in the seal between the permeable film and the support member flange is a foreign object, here a drawstring, present at the seal which forms an open channel upon its removal. FIG. 6 shows a package 50 in accordance with the present invention having a tray or support member 52 with a cavity 54 for receiving a product 56. Unlike the trays shown for all of the other embodiments of the present invention, support member 52 has a single flange 58. Although a dual flange tray may be employed in the present embodiment, this embodiment is especially adaptable for use with a conventional single flange tray. A drawstring 61 is provided between permeable film 68 and flange 58 and is incorporated into the seal between the two. Preferably, the drawstring is coated with a sealable substance so that it is sealed to the flange and the film, rather than being merely physically trapped within the seal. However, the drawstring may be either coated or non-coated such that it either seals well (as with a sealable resin coating), seals loosely (such as may be achieved with a wax coating), or does not seal at all to the flange and the film.

For the present embodiment there is no open channel into tray cavity 54 until one is made by removal of the drawstring at retail as is illustrated in FIG. 7. Although FIG. 7 demonstrates removal of the drawstring 61 by pulling it along the length of the sealed area between permeable film 68 and flange 58 to form an enlarged open channel, it is also within the scope of the present invention to pull the drawstring straight from the package to form smaller channels having dimensions substantially equal to the those of the drawstring itself.

Although the present embodiment may employ separate permeable and impermeable films, it is unique in that there is no need for the impermeable film to enclose an open channel or channels because there are no open channels until the package is handled at retail. Thus, the permeable and impermeable films may comprise a single film which can be delaminated into permeable and impermeable webs. Such a multilayer film is sealed to the tray flange with the permeable layer or layers adjacent to the tray and the impermeable layer or layers forming an uppermost surface. At retail the impermeable web is delaminated from the film leaving the permeable web sealed to the tray. The drawstring is then removed to form open channels into the tray cavity in order to allow for the rapid introduction of oxygen to the packaged fresh red meat. As an alternative, an impermeable film may be sealed to or laminated to a permeable film during packaging for the same end result at retail.

As with many of the other embodiments of the invention described herein, the impermeable film can be integral with and peelable from the permeable film and thus sealed at the same location on the single flange; or, the impermeable film can comprise a separate film overlying the permeable film and optionally sealed at a separate location on the flange. As a further alternative the present package may include an impermeable film only. The removal of one or more drawstrings may be employed to form open channels for sufficient gas exchange without the use of a permeable film.

If, however, a dual flange, dual film approach is employed, the drawstring may advantageously be tucked into the depression between the flange portions such that it does not extend into the seal between the outer flange portion and the impermeable film and out of the package itself during transport. Thus, possible contamination of the drawstring and, consequently, the package can be avoided.

As an alternative to a foreign object at the flange/permeable film seal which is removed in order to provide for a gas exchange at retail, FIGS. 8 and 9 show an object which is not removed but which provides for an introduction of oxygen upon removal of an upper impermeable web. FIG. 9 shows a cross-section of package 70 in accordance with the present invention having a tray or support member 72 with a cavity 74 for receiving a product and an flange 78 which includes inner flange portion 80 and outer flange portion 82 separated by depression 84.

In the present embodiment, inner flange portion 80 has sealed to the upper surface thereof a permeable gasket 81 which extends about the perimeter of the tray at that upper surface and a permeable film sealed over the gasket along the inner flange. The permeable gasket can be continuous around the entire inner flange or a segment, depending upon the oxygen permeability required for the package or other factors. A top impermeable film 86 is sealed to the support member at outer flange portion 82. Hereagain, it is preferred that a peelable seal is formed between the impermeable film 86 and outer flange portion 82 such that the outer impermeable film may be readily removed from the package at retail.

FIG. 8 is an enlarged sectional view of the flange 78 of package 70 after removal of impermeable film 86. Permeable film 88 is sealed to the gasket 81 which is sealed to inner flange portion 80. Optionally, a gasket may be applied to the flange with an adhesive and then heat sealed to the permeable film. Gasket 81 may be perforated or porous but preferably has a permeability allowing for gas diffusion into the package equivalent to a package having a permeable film having an oxygen transmission rate of greater than about 100,000 $cc/m^2/24$ hr. 1 atm. 73° F. Furthermore, as an alternative, a smaller object which is porous, perforated, or has at least one channel defined therethrough may be contained between and sealed to permeable film 88 and inner flange portion 80 without being a gasket, such as the segment described above. That is, one or more of such highly transmissible objects may be contained within that seal in order to allow for a release of any contained low oxygen gases and a rapid introduction of oxygen into the tray cavity upon removal of the impermeable film. Inter alia, the term "discontinuities" as used herein therefore includes, for example, the nonsealed areas or channels described above that are formed by a nonsealable substance, a nonsealable portion of the permeable film or substrate, a foreign object, e.g. a drawstring, and/or a permeable gasket.

The permeable film or web of the present invention is an oxygen permeable or non-barrier film or skin which may be a formable or stretchable material. Typical polymeric materials for the present permeable film may include any material which may be securely sealed and bonded to the support member, such as polyethylene or any of a variety of ethylene copolymers including, for example, ethylene vinyl acetate, ethylene acrylate copolymers, ethylene acrylic acid copolymers including metal neutralized salts thereof, and ethylene alpha-olefin copolymers. Such ethylene alpha-olefins may be heterogeneous or homogeneous in nature. That is, ethylene alpha-olefins which have been formed by conventional Zeigler-Natta catalysis and are heterogeneous in nature, such as linear low density polyethylene (LLDPE), are within the scope of the present invention as well as such copolymers which are formed by single site catalysis, such as any of a variety of forms of metallocene catalyst technology, and are homogeneous in nature are also within the scope of the present invention. A preferred permeable film for use in accordance with the present invention is a symmetrical, five layer oriented film having the structure:

EVA/LLDPE/EVA/LLDPE/EVA although a wide variety of permeable films may be employed.

The impermeable film or web of the present invention may be any suitable barrier layer, film or laminate which is substantially impermeable to gas such as oxygen so that a fresh meat product contained in a vacuum or other low oxygen atmosphere possesses an enhanced shelf life over a package without the barrier layer. Suitable polymeric materials having gas barrier properties for use in the present invention include ethylene vinyl alcohol copolymers, vinylidene chloride copolymers (PVDC) such as vinylidene chloride vinyl chloride or vinylidene chloride methyl acrylate. Laminates of a sealable film and a barrier structure which includes a barrier layer and a tough, nonforming material such as a biaxially oriented nylon or biaxially oriented polyester are especially preferred for use as the impermeable lidding of the present inventive packages. A preferred impermeable web has the structure:

biax nylon/PVDC//EVA/LLDPE/seal wherein the double slashes (//) indicate adhesive lamination of the two webs, although a variety of laminates and multilayer films may be employed as the impermeable web of the present invention.

Generally, the films or webs which may be employed in accordance with the present invention may be monolayer or multilayer. Multilayer films may be employed when all of the properties required of the film cannot be achieved by a single polymeric component or a blend of polymers in a single layer. For example, an impermeable film to be sealed to a tray in all likelihood will comprise a multilayer film because several properties are needed including peelable sealability, oxygen barrier and impact properties and outer abuse properties. Thus, the film employed will most likely contain three layers at a minimum: a seal layer, a barrier layer and an outer abuse layer. Further internal layers such as adhesive layers and bulk layers may also be included. Laminates of sealable films and nonforming materials such as biaxially oriented polyester or biaxially oriented nylon are also within the scope of the present invention and are widely recognized as superior lidstocks for tray-type packages.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A package for a product, comprising:

a support member having a peripheral flange and a cavity for receiving a product;

a permeable film partially sealed to said flange to enclose the product;

at least one channel between said permeable film and said flange defined by at least one corona-treated area of said flange or said permeable film, said corona-treated area preventing said permeable film from sealing to said flange; and an impermeable film enclosing said permeable film and said at least one channel, said impermeable film being removable from said package such that removal thereof allows gas to flow into and out of said cavity through said at least one channel.

2. A package for a product, comprising:

a support member having a peripheral flange and a cavity for receiving a product;

a permeable film partially sealed to said flange to enclose the product;

at least one channel between said permeable film and said flange, said channel comprising at least one groove in said flange; and an impermeable film enclosing said permeable film and said channel, said impermeable film being removable from said package such that removal thereof allows gas to flow into and out of said cavity through said at least one channel.

* * * * *